United States Patent [19]

Shimanaka et al.

[11] 4,113,530

[45] Sep. 12, 1978

[54] METHOD FOR FORMING A HEAT-RESISTANT INSULATING FILM ON A GRAIN ORIENTED SILICON STEEL SHEET

[75] Inventors: Hiroshi Shimanaka, Funabashi; Toshio Ichida; Shigeru Kobayashi, both of Chiba, all of Japan

[73] Assignee: Kawasaki Steel Corporation, Kobe, Japan

[21] Appl. No.: 760,376

[22] Filed: Jan. 18, 1977

Related U.S. Application Data

[63] Continuation-in-part of Ser. No. 570,173, Apr. 21, 1975, abandoned.

[30] Foreign Application Priority Data

Apr. 23, 1974 [JP] Japan ..... 49-45036

[51] Int. Cl.$^2$ ..... H01F 1/04

[52] U.S. Cl. ..... 148/113; 148/13.1; 148/27; 148/31.5; 148/31.55; 148/122; 427/126; 427/127

[58] Field of Search ..... 148/113, 31.5, 27, 122, 148/13.1, 31.55, 111; 427/126, 127

[56] References Cited

U.S. PATENT DOCUMENTS

| | | | |
|---|---|---|---|
| 3,627,594 | 12/1971 | Yamamoto et al. | 148/113 |
| 3,653,984 | 4/1972 | Urushiyama et al. | 148/113 |
| 3,676,227 | 7/1972 | Matsumoto et al. | 148/111 |
| 3,819,427 | 6/1974 | Baesch | 148/122 |
| 3,956,029 | 5/1976 | Yamamoto et al. | 148/27 |

*Primary Examiner*—R. Dean
*Assistant Examiner*—John P. Sheehan

[57] ABSTRACT

A uniform and high adhesive heat-resistant insulating film can be formed on a silicon steel sheet by applying an annealing separator consisting mainly of magnesia and containing 1–10% of titanium oxide having such a particle size that at least 99.5% of the agglomerated particles passes through 325-mesh sieve and having a dispersion degree in water of at least 85%.

5 Claims, 2 Drawing Figures

10μ

Figure 1:
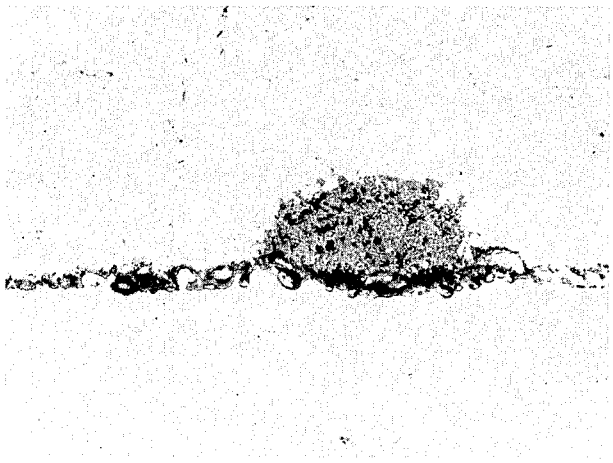

METHOD FOR FORMING A HEAT-RESISTANT INSULATING FILM ON A GRAIN ORIENTED SILICON STEEL SHEET

This application is a continuation-in-part of our copending application Ser. No. 570,173, filed Apr. 21, 1975, and now abandoned.

The present invention relates to a method for forming a heat-resistant insulating film on a grain oriented silicon steel sheet or strip containing 2.0–4.0% by weight of silicon. Particularly, the present invention relates to a method for forming a heat-resistant insulating film on the above described steel sheet or strip by using an annealing separator containing $TiO_2$.

In general, insulating films are formed on a grain oriented silicon steel sheet by a method wherein a cold rolled silicon steel strip having a desired final gauge is annealed at a temperature of 700°–900° C for 1–10 minutes in wet hydrogen to remove carbon contained in the steel strip and at the same time to oxidize the surface portion of the steel strip, forming a sub-scale containing $SiO_2$ on the surface of the steel strip, and then an annealing separator consisting mainly of MgO is applied on the steel strip, after which the steel strip is wound up in the form of a coil and subjected to a final annealing at a temperature of 1,000°–1,200° C in a reducing or non-oxidizing atmosphere.

There have been made various investigations with respect to the annealing separator used in the above described method, because the annealing separator has a great influence upon the formation of insulating film. Japanese Pat. Application Publication Nos. 2,858/50, 42,298/71 and 42,299/71 and U.S. Pat. No. 3,627,594 disclose that addition of $TiO_2$ to an annealing separator consisting mainly of MgO can improve properties of an insulating film.

However, when $TiO_2$ is used, a large number of black particles are often formed and adhered to the surface of the insulating film. The black particles cannot be removed by an ordinary washing by means of a brush, which is carried out in order to remove unreacted annealing separator after the final annealing. When a silicon steel sheet having the black particles is applied with a film consisting mainly of phosphate, the appearance of the steel sheet having the film is poor due to the presence of the black particles, and further when the silicon steel sheet having such film is constructed into a transformer core, the space factor of the transformer core is decreased. Moreover, at the construction of the transformer core, the insulating film is peeled off together with the black particles due to the friction between laminated steel sheets, and the silicon steel base metal is locally exposed to decrease the interlaminate resistance. Though the black particles can be removed by brushing violently the silicon steel sheet surface, the insulating film is peeled off together with the particles to expose the base metal, and the appearance of the film becomes considerably poor, and further the interlaminate resistance of the steel sheet is low after the steel sheet is constructed into a transformer coil.

Due to the above described reasons, the development of methods for preventing the formation of the black particles has hitherto been largely demanded.

An object of the present invention is to provide a method which can prevent the formation of black particles and can form a smooth and highly adhesive heat-resistant insulating film.

Another object of the present invention is to provide a smooth and uniform heat-resistant insulating film having a high adhesion to steel sheet.

Figure 2:
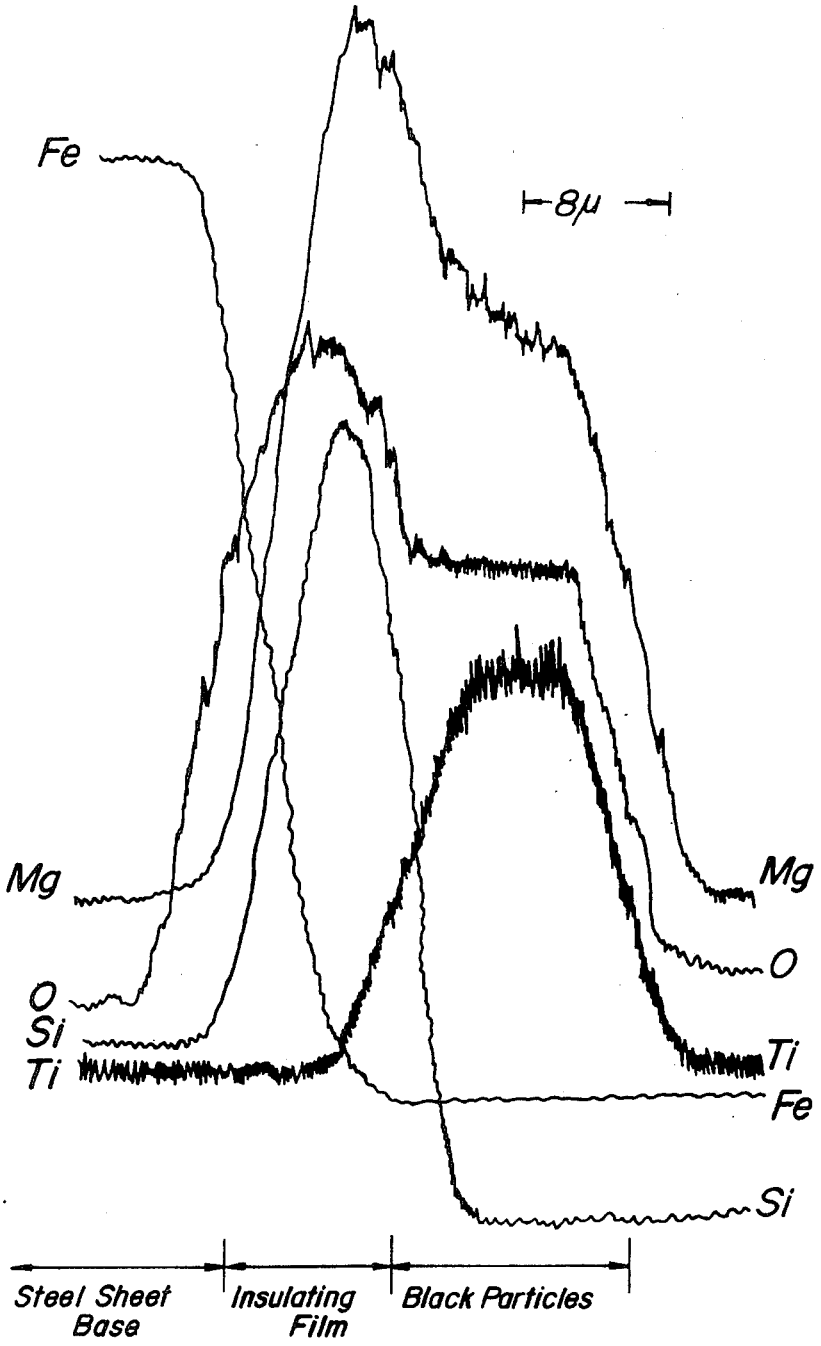

For a better understanding of the invention, reference is taken to the accompanying drawings, wherein:

FIG. 1 is a micrograph (magnification: ×600) showing a vertical cross-section of the black particles which are cut in a direction perpendicular to the silicon steel; and FIG. 2 shows the result of the line analysis of black particles on the insulating film surface by means of an X-ray microanalyzer.

Firstly, an explanation will be made with respect to an investigation, which has been carried out in order to clarify the cause of formation of the black particles when an annealing separator containing $TiO_2$ is used. FIG. 1 is a microphotograph in 600 magnification of the cross-section of the black particles adhered to the silicon steel sheet surface. A color tone of the black particles is different from that of the insulating film. Some of the black particles have a diameter of as large as 40–50 μ. Next, a line analysis of the black particles was effected by means of an X-ray microanalyzer. FIG. 2 shows the result. It was found from the line analysis that the black particles were mainly composed of Mg, Ti and O and had a composition different from that of the heat-resistant insulating film consisting mainly of forsterite ($2MgO.SiO_2$). However, since the line analysis alone is still insufficient for clarifying the cause of the formation of the black particles, an identification test of the black particles was effected by the X-ray diffraction analysis. The following Table 1 shows the result of the identification test of unreacted annealing separator after the final annealing with the black particles formed on the surface of the heat-resistant insulating film by the X-ray diffraction analysis.

Table 1

| Sample | Result of identification by the X-ray diffraction analysis |
|---|---|
| Unreacted annealing separator | large amount of MgO, small amount of $MgTi_2O_4$ |
| Black particles | large amount of $MgTi_2O_4$, very small amount of $2MgO . SiO_2$ |

As shown in Table 1, the X-ray diffraction peak of MgO was not observed in the X-ray diffraction pattern of the black particles. The unreacted annealing separator was composed of a large amount of MgO and a small amount of $MgTi_2O_4$, while the black particles were substantially composed of only $MgTi_2O_4$. This phenomenon is probably due to the reason that all of $TiO_2$ particles are formed into $MgTi_2O_4$ particles, and among the $MgTi_2O_4$ particles, $MgTi_2O_4$ particles formed from $TiO_2$, which has been agglomerated into a large size, is formed into the black particles. A very small amount of $2MgO.SiO_2$ was detected in the black particles by the X-ray diffraction analysis as shown in Table 1. This phenomenon is probably due to the intermixing of heat-resistant insulating film, which has been present under the black particles and has been dropped off together with the black particles at the sampling.

It is deduced from the result of the above investigation that agglomerated $TiO_2$ particles in the annealing separator are directly formed into $MgTi_2O_4$ and adhered to the film to form the black particles. While, commercially available $TiO_2$ has generally a primary particle size of not larger than micron order, and most of the $TiO_2$ particles are very fine. If the $TiO_2$ were completely dispersed in an annealing separator in the form of primary particles, the above described large black particles would not be formed. However, a large number of primary particles of the $TiO_2$ are agglomerated into secondary particles, and when the $TiO_2$ and MgO are dispersed in water to produce an annealing separator for grain oriented silicon steel sheet, a major part of the primary particles of the $TiO_2$, although the primary particles are fine, are often agglomerated into secondary particles due to the presence of ionic impurities, which are incorporated into the $TiO_2$ particles during the course of the production of the $TiO_2$, and the agglomerated particles apparently form coarse secondary particles. The inventors have found out that the agglomerated particles as such are applied on a steel sheet without separated into primary particles in the aqueous dispersion and are formed into the black particles. The inventors have investigated the condition, under which black particles are not formed, and found out that the formation of black particles can be prevented by the use of $TiO_2$ having such a particle size that the content of agglomerated particles impassable through 325-mesh sieve (hereinafter, the "content of agglomerated particles impassable through 325-mesh sieve" is referred to as 325-mesh impassable agglomerated particle content) is less than 0.5% by weight and having a dispersion degree in water of at least 85%.

In the investigation of the present invention, the 325-mesh impassable agglomerated particle content in $TiO_2$, the primary particle size of $TiO_2$ and the dispersion degree of $TiO_2$ in water were measured in the following manner.

The 325-mesh impassable agglomerated particle content in $TiO_2$ was measured by the following sieve test. A predetermined amount of $TiO_2$ is dispersed in water and poured on a 325-mesh Tyler standard sieve, and the residual $TiO_2$ on the sieve is uniformly swept by means of a soft brush while pouring water on the $TiO_2$, sprayed with acetone and dried at 110° C. The weight percent of the residual $TiO_2$ based on the weight of the originally dispersed $TiO_2$ is measured, which is the 325-mesh impassable agglomerated particle content in $TiO_2$.

The dispersion degree of $TiO_2$ in water was measured in the following manner. 20 g of $TiO_2$ particles is mixed with 450 cc of distilled water or demineralized water at room temperature. After the resulting mixture is stirred for 3 minutes, the mixture is charged in a measuring cylinder of 1 l capacity, and distilled water or demineralized water is further added to the mixture to make up the total amount of 1 l. After the resulting dispersion was left to stand for 2 hours, 250 cc of the upper layer is sampled, and the amount of $TiO_2$ contained therein is weighed and the dispersion degree of the $TiO_2$ in water is calculated by the following formula.

$$\text{Dispersion degree in water (\%)} = \text{Amount (g) of } TiO_2 \text{ in 250 cc of upper layer} \times \frac{4}{20g} \times 100$$

The primary particle size was measured in the following manner. $TiO_2$ powder sample is observed by an electron microscope, and the diameter of the minimum unit particles forming the primary particle is measured.

The present invention will be explained in more detail with reference to experimental data.

In the investigation of the present invention, heat-resistant insulating films were produced in the following manner. Each of 6 kinds of titanium oxides (A)–(F) having different properties from each other as shown in the following Table 2 was mixed with a light magnesia (trademark Maglight S-3331, made by Merck Co., U.S.A.), which is used as an MgO annealing separator, to prepare an annealing separator containing 5% by weight of $TiO_2$. The annealing separator was formed into a slurry, applied on a silicon steel sheet, on which sub-scale had previously been formed, and dried. Then, the steel sheet was wound up in the form of a coil and subjected to a final annealing at 1,200° C for 20 hours under hydrogen atmosphere to form a heat-resistant insulating film on the steel sheet. For comparison, an annealing separator consisting of the light magnesia alone and containing no $TiO_2$ was used and a heat-resistant insulating film was formed on the steel sheet in the same manner as described above.

Properties of the resulting 7 kinds of heat-resistant insulating films are shown in the following Table 2.

Table 2

| | | Annealing Separator | | | | | | |
|---|---|---|---|---|---|---|---|---|
| | | MgO alone | 5 wt.% of $TiO_2$ (A) and the remainder being MgO | 5 wt.% of $TiO_2$ (B) and the remainder being MgO | 5 wt.% of $TiO_2$ (C) and the remainder being MgO | 5 wt.% of $TiO_2$ (D) and the remainder being MgO | 5 wt.% of $TiO_2$ (E) and the remainder being MgO | 5 wt.% of $TiO_2$ (F) and the remainder being MgO |
| Property of $TiO_2$ | 325-mesh impassable agglomerated particle content (%) | — | 1.5 | 1.5 | 1.5 | 0.4 | 0.4 | 0.4 |
| | Dispersion degree in water (%) | — | 16 | 53 | 95 | 13 | 47 | 95 |
| | Primary particle size ($\mu$) | — | 0.3 ± 0.1 | 0.3 ± 0.1 | 0.3 ± 0.1 | 0.3 ± 0.1 | 0.3 ± 0.1 | 0.3 ± 0.1 |
| Property of heat-resistant insulating film | Appearance | Film has different color tone in the center portion and edge portion of the width direction of the sheet, and is considerably ununiform. | Film is fairly uniform, but white-grey stripes are often observed in the edge portion of the width direction of the sheet. | Film is fairly uniform, but white-grey stripes are often observed in the edge portion of the width direction of the sheet. | Film is quite uniform in any of the width and length directions and the both surfaces of the sheet. | Film is fairly uniform, but white-grey stripes are often observed in the edge portion of the width direction of the sheet. | Film is fairly uniform, but white-grey stripes are often observed in the edge portion of the width direction of the sheet. | Film is quite uniform in any of the width and length directions and the both surfaces of the sheet. |
| | Adhesion at bending* (minimum diameter of steel rod) (mm) | Larger than 50 | 40 | 40 | Smaller than 10 | 40 | 40 | Smaller than 10 |
| | Smoothness of surface | Smooth | 120 black particles are adhered per 1,000 $cm^2$ of film surface. Film surface is rough. | 60 black particles are adhered per 1,000 $cm^2$ of film surface. Film surface is rough. | 40 black particles are adhered per 1,000 $cm^2$ of film surface. Film surface is rough. | 80 black particles are adhered per 1,000 $cm^2$ of film surface. Film surface is rough. | 30 black particles are adhered per 1,000 $cm^2$ of film surface. Film surface is rough. | Smooth (no black particles) |
| | Space factor (%) | 98.0 | 95.5 | 95.5 | 96 | 96 | 96.5 | 98.2 |
| | Inter-laminate resistance ($\Omega \cdot cm^2$/sheet) | 0.4 | 1.8 | 2.1 | 3.0 | 2.8 | 5.0 | 20.0 |

Note:
*Minimum diameter of a steel rod which does not cause peeling of a film when a silicon steel sheet having the film applied thereon is bend by 180° around the steel rod.

As seen from Table 2, when an annealing separator containing $TiO_2$ is used, the resulting insulating film is superior to that formed by using the annealing separator of MgO alone in the appearance and adhesion at bending as commonly known. When the annealing separator containing $TiO_2$ (C) or (F) having a high dispersion degree in water is used, the resulting insulating film is remarkably superior to those obtained by using the annealing separator containing $TiO_2$ (A), (B), (D) or (E) in both of the appearance and adhesion at bending. Further, the separator of MgO alone and the separator containing $TiO_2$ (F) are superior to the separator containing $TiO_2$ (A), (B), (C), (D) or (E) in the smoothness of the resulting insulating film surface. As for the improvement of the space factor of the resulting insulating film, the separator containing $TiO_2$ (F) is most effective and the separator of MgO alone is next to the separator containing $TiO_2$ (F) and the separator containing $TiO_2$ (A), (B), (C), (D) or (E) are inferior to the separator of MgO alone. As for the improvement of the interlaminate resistance of the resulting insulating film, the separator containing $TiO_2$ (F) is most effective and the separator containing $TiO_2$ (A), (B), (C), (D) or (E) is next to the separator containing $TiO_2$ (F) and the separator of MgO alone is poorest in the effect. That is, it can be seen from Table 2 that $TiO_2$ to be added to MgO must have such a particle size distribution that 325-mesh impassable agglomerated particle content is less than 0.5% by weight and must have a dispersion degree in water of at least 95% in order to obtain an insulating film having excellent appearance, adhesion, interlaminate resistance and smoothness.

The inventors have deduced from the result of the investigation described above that the formation of black particles would be probably caused due to the presence of agglomerated $TiO_2$ particles. The result shown in the above Table 2 show that $TiO_2$, which does not substantially contain agglomerated particles (325-mesh impassable agglomerated particles) and whose primary particles are hardly agglomerated when the $TiO_2$ is dispersed in water, leads to good results. Therefore, the result shown in Table 2 agrees with the above described deduction.

The inventors have further made the following investigations in order to clarify the corelation between the dispersion degree in water of $TiO_2$ contained in the annealing separator and the formation of the black particles. That is, the above described $TiO_2$ (D) and $TiO_2$ (F) were mixed in various mixing ratios, and each of the resulting mixtures was added to MgO to prepare an annealing separator, so that the resulting annealing separator contained 5% by weight of the $TiO_2$ mixture. The resulting annealing separator was made into a slurry, applied on a silicon steel sheet and dried. The steel sheet with the separator was wound up in the form of a coil and subjected to a final annealing. The following Table 3 shows a relation between the dispersion degree of the $TiO_2$ in water and the properties of the resulting heat-resistant insulating film.

Table 3

| Separator No. | Dispersion degree of $TiO_2$ in water (%) | Property of heat-resistant insulating film: Interlaminate resistance ($\Omega \cdot cm^2$/sheet) | Adhesion at bending (mmϕ) | Appearance of film surface |
|---|---|---|---|---|
| 1 | MgO alone | 0.4 | larger than 50 | Film surface is smooth but has dark and light grey ununiform color. |
| 2 | 95 | 25.0 | smaller than 10 | Film surface is smooth and has dark grey uniform color. |
| 3 | 91 | 20.8 | " | " |
| 4 | 86 | 22.0 | " | " |
| 5 | 78 | 5.0 | 50 | Film surface has somewhat dark and light grey ununiform color, and 20 black particles are adhered per 1,000 $cm^2$ of film surface. |
| 6 | 65 | 4.3 | 50 | Film surface has somewhat dark and light grey ununiform color, and 60 black particles are adhered per 1,000 $cm^2$ of film surface. |
| 7 | 53 | 3.1 | 50 | Film surface has somewhat dark and light grey ununiform color, and 60 black particles are adhered per 1,000 $cm^2$ of film surface. |

As seen from Table 3, $TiO_2$ having a dispersion degree in water of at least 85% improves the adhesion of the resulting film. That is, Table 3 shows quantitatively the fact that $TiO_2$ having a high dispersion degree in water forms a film having an adhesion remarkably higher than that formed by the use of commonly used $TiO_2$ having a poor dispersion degree in water.

Further, it can be seen from Table 3 that the formation of black particles in the use of an MgO annealing separator containing commonly used $TiO_2$ is due to poor dispersion of the $TiO_2$ in water and agglomeration of the $TiO_2$ particles, and that, when an MgO annealing separator containing $TiO_2$ having a dispersion degree in water of at least 85% is used, black particles are not formed, and an insulating film having a smooth surface is obtained, and further the film is tightly and uniformly adhered to the steel sheet to cover the sheet, and the interlaminate resistance of the steel sheet is improved. Further, it can be seen from Table 3 that it is more preferable to use $TiO_2$ having a dispersion degree in water of at least 95% in order to form a heat-resistant insulating film which gives a high interlaminate resistance to steel sheet. That is, when $TiO_2$ having a high dispersion degree in water is used, the $TiO_2$ serves effectively to improve the adhesion of the resulting forsterite-ceramic film.

In the present invention, $TiO_2$ having a dispersion degree in water of at least 85% is used. However, merely such limitation of the property of $TiO_2$ cannot prevent completely the formation of black particles. The inventors have made further investigations and found out that, even when $TiO_2$ having a dispersion degree in water of at least 85% is used, if the $TiO_2$ has a particle size containing a large amount of 325-mesh impassable agglomerated particles, black particles are formed on the forsterite-ceramic film, and that, when $TiO_2$ containing less than 0.5% by weight of 325-mesh impassable agglomerated particles is used, the formation of black particles can be completely prevented. Further, in the present invention, it is preferable to use $TiO_2$ having such a particle size that all of the above described 325-mesh impassable agglomerated particles pass through 100-mesh Tyler standard sieve.

Further, it is commonly known that the proper amount of $TiO_2$ to be contained in the annealing separator is 1–10% by weight, and in the present invention also, $TiO_2$ is used in this range. However, it is necessary that the amount of $TiO_2$ to be contained in the annealing separator should be varied depending upon the composition of silicon steel sheet, the thickness of sub-scale in the surface layer of steel sheet after decarburization annealing, the atmosphere of final annealing and the thermal cycle. For example, when it is intended to produce grain oriented silicon steel sheets having a high magnetic induction of more than 1.88 wb/m$^2$ by a method, wherein a silicon steel sheet is kept in nitrogen atmosphere at a temperature of 800°–900° C for 10–100 hours to develop secondary recrystallized grains of (110)[001] orientation and then the steel sheet is subjected to a final annealing at a temperature higher than 1,000° C in hydrogen atmosphere to effect purification of the steel and formation of forsterite-ceramic film, the amount of $TiO_2$ to be contained in the annealing separator should be limited to not more than 7% by weight in order to prevent the increase of iron loss. In general, it is preferable to mix relatively small amount of $TiO_2$ with MgO in order to give a high magnetic induction to grain oriented silicon steel sheet, and 1–8% by weight of $TiO_2$ is preferably mixed with MgO.

In the present invention, any kind of MgO, which has hitherto been commonly used for silicon steel, can be used as a main component of annealing separator. Further, MnO, $MnO_2$, $Cr_2O_3$, $V_2O_5$ and the like, which have hitherto been mixed to annealing separator in a small amount, may be mixed to the annealing separator of the present invention.

The following examples are given for the purpose of illustration of this invention and are not intended as limitations thereof.

EXAMPLE 1

A 3.3% silicon steel strip having a thickness of 0.3 mm, a width of 970 mm and a length of about 2,500 m was subjected to a decarburization annealing at 820° C for 5 minutes in an atmosphere composed of 65% of hydrogen and the remainder of nitrogen and having a dew point of 60° C, and an annealing separator consisting of magnesia and titanium oxide (F) shown in the above Table 2 and having a composition as shown in the following Table 4 was applied thereto. The steel strip with the separator, after dried, was wound up in the form of a coil and subjected to a final annealing at 1,200° C for 20 hours in hydrogen atmosphere. Properties of the resulting heat-resistant insulating film are shown in Table 4. The magnesia used in this Example 1 is the above described Maglite-S3331 made by Merck Co. in U.S.A. The titanium oxide used in this Example 1 is $TiO_2$ (F) shown in Table 2 as described above which has a 325-mesh impassable agglomerated particle content of 0.4% and a dispersion degree in water of 95%. It can be seen from Table 4 that a heat-resistant insulating film having a satisfactorily excellent property can be obtained by the use of an MgO annealing separator containing 2–10% by weight of $TiO_2$ having a high dispersion degree in water, as shown as annealing separator Nos. *a*, *b* and *c*.

Table 4

| Annealing separator | Annealing separator: Composition (wt. %) | | Dispersion degree of $TiO_2$ in water | Property of heat-resistant insulating film: Inter-laminate resistance | Adhesion test by 180° bending | | | Appearance of | |
|---|---|---|---|---|---|---|---|---|---|
| No. | MgO | $TiO_2$ | (%) | (Ω . cm$^2$/sheet) | 10 mmϕ | 30 mmϕ | 50 mmϕ | film surface | Remarks |
| a | 98 | 2 | 95 | 15 | not peeled | not peeled | not peeled | Film surface has dark grey uniform color, and is smooth. | Present invention |
| b | 95 | 5 | 95 | 21 | not peeled | not peeled | not peeled | Film surface has dark grey uniform color, and is smooth. | Present invention |
| c | 90 | 10 | 95 | 23 | not peeled | not peeled | not peeled | Film surface has dark grey uniform color, and is smooth. | Present invention |

EXAMPLE 2

A 3% silicon steel strip having a thickness of 0.3 mm, a width of 970 mm and a length of 2,500 m was subjected to a decarburization annealing at 800° C for 5 minutes in an atmosphere composed of 60% of hydrogen and the remainder of nitrogen and having a dew point of 60° C, and an annealing separator having a composition as shown in the following Table 5 was applied thereto. The steel strip with the separator, after dried, was wound up in the form of a coil, kept in nitrogen atmosphere at a temperature of 850° C for 50 hours to develop secondary recrystallized grains of (110)[001] orientation, and then subjected to a final annealing at 1,200° C for 20 hours in hydrogen atmosphere. Properties of the resulting forsterite-ceramic heat-resistant insulating film and magnetic properties of the above treated silicon steel strip are shown in Table 5. The magnesia and titanium oxide used in this Example 2 are the same as those used in Example 1.

Table 5

| Annealing separator No. | Annealing separator: Composition (wt. %) MgO | $TiO_2$ | Dispersion degree of $TiO_2$ in water (%) | Property of heat-resistant insulating film: Inter-laminate resistance ($\Omega \cdot cm^2$/sheet) | Adhesion test by 180° bending: 10 mmϕ | 30 mmϕ | 50 mmϕ | Appearance of film surface | Magnetic property of silicon steel sheet: $W_{17/50}$ | $B_8$ ($wb/m^2$) | Remarks |
|---|---|---|---|---|---|---|---|---|---|---|---|
| d | 98 | 2 | 95 | 17 | not peeled | not peeled | not peeled | Film surface has dark grey uniform color, and is smooth. | 1.12 | 1.91 | Present invention |
| e | 93 | 7 | 95 | 21 | not peeled | not peeled | not peeled | Film surface has dark grey uniform color, and is smooth. | 1.11 | 1.92 | Present invention |
| f | 90 | 10 | 95 | 23 | not peeled | not peeled | not peeled | Film surface has dark grey uniform color, and is smooth. | 1.18 | 1.91 | Present invention |

What is claimed is:

1. In a method for forming a heat resistant insulating film on a grain oriented silicon steel sheet, wherein a cold rolled silicon steel strip containing 2–4% by weight of Si and having a desired final gauge is subjected to a decarburization annealing at a temperature of 700°–900° C for 1–10 minutes in wet hydrogen to remove carbon contained in the steel strip and at the same time to oxidize silicon contained in the strip, forming an oxide film containing silica ($SiO_2$) on the surface of the steel strip, and an annealing separator consisting mainly of MgO is applied on the steel strip after which the steel strip is wound up in the form of a coil and subjected to a final annealing at a temperature of 1,000°–1,200° C under hydrogen atmosphere, the improvement comprising using an annealing separator containing 1–10% by weight of titanium oxide ($TiO_2$) having such a particle size that at least 99.5% by weight of the agglomerated particles passes through 325-mesh (44u) Tyler standard sieve and having a dispersion degree in water of at least 85%, so as to substantially avoid black $MgTi_2O_4$ particle formation.

2. A method according to claim 1, wherein all of the 325-mesh impassable agglomerated particles pass through 100-mesh Tyler standard sieve.

3. A method according to claim 1, wherein said separator contains 1–8% by weight of $TiO_2$.

4. A method according to claim 1, wherein said $TiO_2$ has a dispersion degree in water of at least 95%.

5. A method according to claim 1, wherein said $TiO_2$ having a dispersion degree in water of at least 85% is a mixture of $TiO_2$ having a dispersion degree in water of at least 85% and $TiO_2$ having a dispersion degree in water of less than 85%.

* * * * *